US009309830B2

(12) United States Patent
Berger et al.

(10) Patent No.: US 9,309,830 B2
(45) Date of Patent: Apr. 12, 2016

(54) CYLINDER HEAD WITH LIQUID-TYPE COOLING

(75) Inventors: Manuel Berger, Wolfern (AT); Christian Auer, Haag (AT)

(73) Assignee: AVL LIST GMBH, Graz (AU)

( * ) Notice: Subject to any disclaimer, the term of this patent is extended or adjusted under 35 U.S.C. 154(b) by 7 days.

(21) Appl. No.: 14/235,506

(22) PCT Filed: Jul. 23, 2012

(86) PCT No.: PCT/EP2012/064366

§ 371 (c)(1), (2), (4) Date: May 6, 2014

(87) PCT Pub. No.: WO2013/014113

PCT Pub. Date: Jan. 31, 2013

(65) Prior Publication Data

US 2014/0305400 A1 Oct. 16, 2014

(30) Foreign Application Priority Data

Jul. 28, 2011 (AT) ..... A 1104/2011

(51) Int. Cl.

| | |
|---|---|
| ***F02F 1/36*** | (2006.01) |
| ***F01P 3/16*** | (2006.01) |
| ***F02F 1/24*** | (2006.01) |
| ***F02F 1/40*** | (2006.01) |

(52) U.S. Cl.

CPC ... *F02F 1/36* (2013.01); *F01P 3/16* (2013.01); *F02F 1/242* (2013.01); *F02F 1/40* (2013.01)

(58) Field of Classification Search

CPC ..... F02F 1/40; F02F 1/242; F02F 1/36; F01P 3/16

USPC ..... 123/193.1, 193.6, 193.5, 193.2, 41.01, 123/41.17, 41.82 R, 41.82 A, 41.85

See application file for complete search history.

(56) References Cited

U.S. PATENT DOCUMENTS

| | | | | |
|---|---|---|---|---|
| 3,769,948 | A * | 11/1973 | Feichtinger et al. | 123/41.31 |
| 6,899,063 | B2 * | 5/2005 | Obermayer et al. | 123/41.31 |
| 6,928,964 | B2 * | 8/2005 | Obermayer et al. | 123/41.82 R |
| 7,069,885 | B2 * | 7/2006 | Iida | 123/41.82 R |
| 7,100,545 | B2 * | 9/2006 | Maassen et al. | 123/41.82 R |
| 2002/0124815 | A1 * | 9/2002 | Ishiguro et al. | 123/41.82 R |
| 2004/0139933 | A1 * | 7/2004 | Obermayer et al. | 123/41.82 R |
| 2005/0145204 | A1 * | 7/2005 | Iida | 123/41.31 |

FOREIGN PATENT DOCUMENTS

| | | |
|---|---|---|
| CS | 214 379 B1 | 4/1982 |
| GB | 1 479 139 A | 7/1977 |

(Continued)

*Primary Examiner* — Lindsay Low
*Assistant Examiner* — Long T Tran
(74) *Attorney, Agent, or Firm* — Jordan IP Law, LLC; Todd A. Vaughn

(57) ABSTRACT

A cylinder head with liquid cooling, and which has an intake port which opens into a combustion chamber, an exhaust port per cylinder, a fuel injection device which opens into the combustion chamber and which adjoins the intake port and the exhaust port, and at least one cooling chamber which is arranged in the cylinder head. A cooling distribution duct, which is drilled or pre-cast, is arranged in a region of the fire deck, and extends substantially parallel to the fire deck and opens into an annular chamber surrounding the fuel injection device. The annular chamber has at least one substantially radial first cooling bore which is directed towards a valve web region formed between the intake port and the exhaust port and which adjoins the fire deck.

20 Claims, 1 Drawing Sheet

(56) References Cited

FOREIGN PATENT DOCUMENTS

| | | | |
|---|---|---|---|
| JP | 2002 256966 | A | 9/2002 |
| JP | 2004 116387 | A | 4/2004 |
| JP | 2008 248894 | A | 10/2008 |

* cited by examiner

CYLINDER HEAD WITH LIQUID-TYPE COOLING

CROSS-REFERENCE TO RELATED APPLICATIONS

The present application is a National Stage Application of PCT International Application No. PCT/EP2012/064366 (filed on Jul. 23, 2012), under 35 U.S.C. §371, which claims priority to Austrian Patent Application No. A 1104/2011 (filed on Jul. 28, 2011), which are each hereby incorporated by reference in their respective entireties.

TECHNICAL FIELD

Embodiments relate to a cylinder head with liquid cooling, comprising an intake port which opens into a combustion chamber, an exhaust port per cylinder, a fuel injection device which opens into the combustion chamber and which adjoins the intake port and the exhaust port, and at least one cooling chamber which is arranged in the cylinder head. A cooling distribution duct, which is drilled or pre-cast, is arranged in a region of the fire deck, and extends substantially parallel to the fire deck and opens into an annular chamber surrounding the fuel injection device. The annular chamber has at least one substantially radial first cooling bore which is directed towards a valve web region formed between the intake port and the exhaust port and which adjoins the fire deck.

BACKGROUND

An internal combustion engine with a cooling system comprising ducts through which a coolant flows is known from German Patent Publication No. DE 24 29 355 A1, in which the cooling ducts are only arranged close to machine regions which tend to overheat in operation. One cooling water duct is arranged in the cylinder head per cylinder between a distributor and an outlet line, which cooling water duct opens into an annular chamber surrounding a fuel injection device. An outlet duct leads from the annular chamber in the valve web region to the main outlet line between the intake port and the exhaust port.

Japanese Patent Publication No. JP 62-169 221 U discloses a cylinder head with two intake ports and two exhaust ports per cylinder, wherein a feed duct opens in the valve web region between the two exhaust valves into an annular chamber surrounding the fuel injection nozzle. A further cooling line leads from this annular chamber to the valve web region between the intake valve and the exhaust valve and further into a cooling chamber.

A cylinder head is further known from Japanese Patent Publication No. JP 01-114 917 U, in which a cooling duct, originating from a water cooling jacket of the cylinder block, leads into an annular chamber surrounding an injection nozzle and thus passes a valve web region between the intake and exhaust valve.

A cylinder head of a water-cooled internal combustion engine with an intake port and an exhaust port is known from Austrian Patent Publication No. AT 389 565 B, as well as a fuel device opening into the combustion chamber, wherein a cooling distribution duct is arranged in the region of the valve web between the two valves, which duct opens into an annular chamber surrounding the fuel injection device. As seen in the direction of flow of the cooling fluid, the fuel injection device is arranged after the valve web region.

Similar cooling arrangements in which the cooling of the fuel injection device occurs only after the valve web region are known from German Patent Publication Nos. DE 20 37 315 A1, DE 32 08 341 A1 or DE 24 17 925 A1.

It has been noticed that with respect to the known arrangements the cooling of some thermally critical regions in the region of the fuel injection device and/or exhaust port may be deficient in some operating ranges.

SUMMARY

It is therefore the object of embodiments to avoid these disadvantages and to enhance the cooling of thermally critical regions.

This is achieved in accordance with embodiments in such a way that at least one further cooling bore, which is preferably directed substantially tangentially towards the exhaust port, originates laterally from the annular chamber and/or from the cooling distribution duct, wherein preferably the valve web region arranged between the intake port and the exhaust port is arranged downstream of the annular chamber as seen in the direction of flow of the coolant.

The cooling distribution duct arranged upstream of the annular chamber can be provided with a flow cross-section which is larger by at least twice for example than the flow cross-section of the first cooling bore and further cooling bores, if any. This ensures high heat transfer into the coolant.

The cooling distribution duct have the same direction as the first cooling bore (valve web cooling bore), wherein the axes of the first cooling bore and the cooling distribution duct can be aligned in parallel, preferably coaxially. The first cooling bore is thus arranged diametrically with respect to the cooling distribution duct, relating to the annular chamber, as a result of which the first cooling bore can be drilled from the side of the cooling distribution duct. This is especially possible in a simple way when the annular chamber is formed by a casting slug of the cylinder head, and by a receiving sleeve for the fuel injection device which is inserted into a bore of the casting slug.

It can be provided for supplying the coolant that at least one supply bore originating from the cylinder head sealing plane opens into the cooling distribution duct. It is also possible to pre-cast the cooling distribution duct and the supply bore.

In order to effectively cool further critical regions of the exhaust port, it is especially advantageous if a second cooling bore is arranged in the region of the fire deck, preferably in the region of the orifice of the cooling distribution duct into the annular chamber. Furthermore, a third cooling bore can originate from an upper region of the annular chamber, wherein preferably the third cooling bore is spaced from the second cooling bore, as seen in the direction of the cylinder axis. Said third cooling bore can also be used for venting the annular chamber.

A highly effective cooling around the fuel injection device, the exhaust port and the region of the valve web between the two valves can be achieved in this manner.

DRAWINGS

Embodiments will be explained below in closer detail by reference to the drawings, in which.

DESCRIPTION

Figure 1:
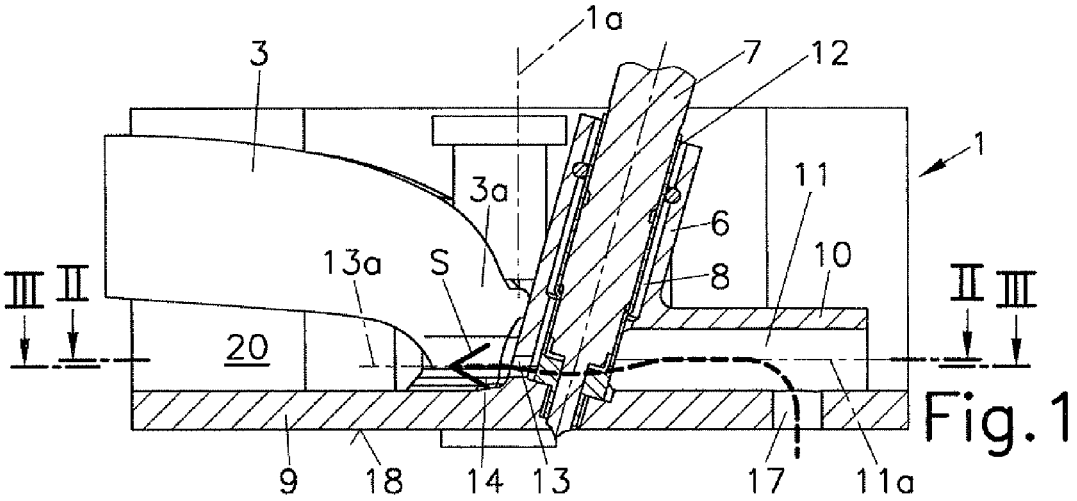
FIG. 1 illustrates a sectional view of a cylinder head in accordance with embodiments along the line I-I in FIG. 2.
Figure 2:
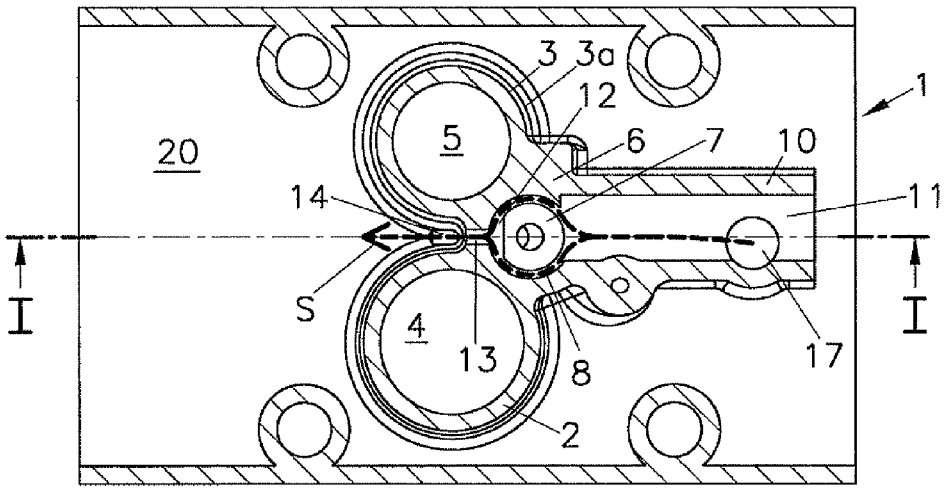
FIG. 2 illustrates the cylinder head in a sectional view along the line II-II in FIG. 1.
Figure 3:
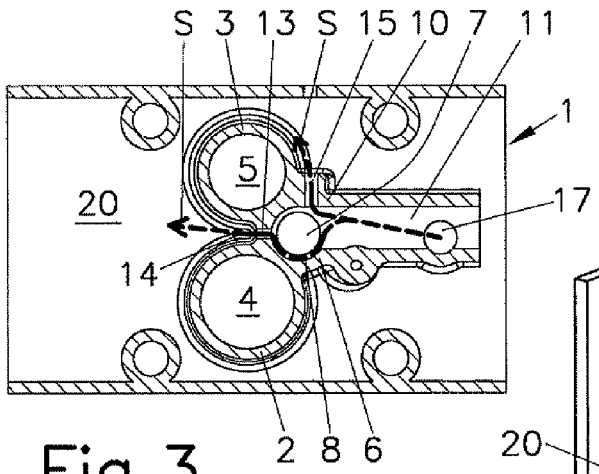
FIG. 3 illustrates the cylinder head in a sectional view along the line III-III in FIG. 1.
Figure 4:
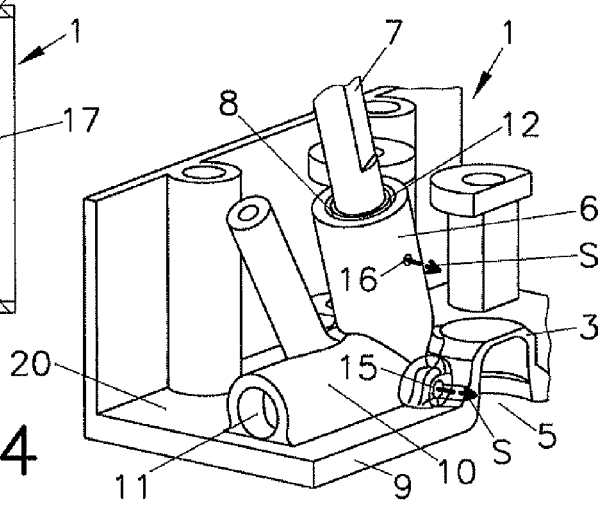
FIG. 4 illustrates the cylinder head in a diagonal view.

As illustrated in FIGS. 1-4, the cylinder head 1 of an internal combustion engine cooled with the cooling fluid comprises an intake port 2 and an exhaust port 3 per cylinder, wherein the intake port 2 and the exhaust port 3 open via an inlet opening 4 or an outlet opening 5 into a combustion chamber (not designated in closer detail). The inlet and outlet openings 4, 5 are controlled by poppet valves (not illustrated in closer detail). A slug 6 (casting slug) for accommodating a fuel injection device 7 opening into the combustion chamber is arranged adjacent to the intake port 2 and the exhaust port 3.

The cylinder head 1 has at least one cooling chamber 20, in which a material accumulation 10 with a drilled or pre-cast cooling distribution duct 11 is arranged in a region of the fire deck 9 of the cylinder head 1. The cooling distribution duct 11 extends substantially parallel to the fire deck 9 and opens into an annular chamber 8 surrounding the fuel injection device 7 for cooling said fuel injection device 7. The annular chamber 8 is formed by the slug 6 and a receiving sleeve 12 for the fuel injection device 7 which is inserted into the slug 6.

The annular chamber 8 has a radial first cooling bore 13 in the region of the fire deck 9, which cooling bore is directed towards a valve web region 14 arranged between the inlet opening 4 and the outlet opening 5. The valve web region 14 is situated downstream of the annular chamber 8, as seen in the direction of flow of the coolant. The first cooling bore 13, which is used for cooling the valve web region 14, has the same orientation as the cooling distribution duct 11, wherein the axes 11*a*, 13*a* of the cooling distribution duct 11 and the first cooling bore 13 are aligned in parallel, preferably coaxially, and can thus be produced in a simpler way.

The cooling distribution duct 11 which is arranged upstream of the annular chamber 8 has a flow cross-section which is equally large or substantially larger (e.g., twice as large) as the flow cross-section of the first cooling bore 13.

In accordance with embodiments, a second cooling bore 15 and a third cooling bore 16 further originate from the annular chamber 8 and/or from the cooling distribution duct 11. The second cooling bore 15 can be arranged in the region of the fire deck 9, e.g. in the region of the entrance of the cooling distribution duct 13 into the annular chamber 8. The third cooling bore 16 originates from an upper region 8*a* of the annular chamber 8 facing away from the fire deck 9 and is spaced from the second cooling bore 15, as seen in the direction of the cylinder axis 1*a*. The second cooling bore 15 and/or the third cooling bore 16 is directed approximately tangentially to the outside surface 3*a* of the exhaust port 3 facing the cooling chamber 20.

A supply bore 17, which penetrates the fire deck 9, opens into the cooling distribution duct 13, which supply bore originates from a cylinder head sealing plane 18 which adjoins a cylinder block (not shown in closer detail). The cooling distribution duct 13 is flow-connected to a cooling jacket in the cylinder block or in the water distribution strip via the supply bore 17.

The coolant flows illustrated by the arrows S from the cooling jacket of the cylinder block through the supply bore 17 into the cooling distribution duct 13 and further into the annular chamber 13, where the fluid flows about the receiving sleeve 12 and thus the fuel injection device 7. Subsequently, the coolant flows through the first cooling bore 13 to the valve web region 14 between the inlet opening 4 and the outlet opening 5, which is thus sufficiently cooled. At the same time, the coolant also flows through the second bore 15 and the third bore 16 to the outside surface 3*a* of the exhaust port 3 and ensures optimal cooling of the exhaust ports. The achieved cooling effect can be adjusted to the respective requirements by suitable dimensioning of the cross-sections of the first, second and third cooling bore 13, 15, 16. After cooling the critical regions of the fuel injection device 7, the valve web region 14 and the exhaust port 3, the coolant is collected in the cooling chamber 20 and is discharged from the cylinder head 1 via outlet openings (not shown in closer detail).

What is claimed is:

1. A cylinder head, comprising:

an intake port which opens into a combustion chamber;

an exhaust port per cylinder;

a fuel injection device which opens into the combustion chamber;

a valve web region formed between the intake port and the exhaust port;

a casting slug having a bore which receives the fuel injection device;

a receiving sleeve received by the bore of the casting slug;

an annular chamber in the bore to concentrically surround the fuel injection device and defined by the casting slug and the receiving sleeve;

a fire deck;

at least one cooling chamber having a cooling distribution duct through which a coolant flows, and which is arranged in a region of, and extends substantially parallel to, a fire deck, and which opens into the annular chamber;

at least one first cooling bore extending from the annular chamber to cool the valve web region, and which adjoins the fire deck; and at least one second cooling bore extending from the annular chamber, and which is directed approximately tangentially to an outside surface of the exhaust port facing the at least one cooling chamber.

2. The cylinder head of claim 1, wherein the valve web region is arranged downstream of the annular chamber relative to a direction of flow of the coolant.

3. The cylinder head of claim 1, wherein the cooling distribution duct has a flow cross-section which is greater than a flow cross-section of the at least one first cooling bore.

4. The cylinder head of claim 1, wherein the cooling distribution duct has a flow cross-section which is at least twice as great as a flow cross-section of the at least one first cooling bore.

5. The cylinder head of claim 1, wherein the axis of the at least one first cooling bore and the axis of the cooling distribution duct are aligned in parallel.

6. The cylinder head of claim 1, wherein the axis of the at least one first cooling bore and the axis of the cooling distribution duct are coaxial.

7. The cylinder head of claim 1, further comprising:

a cylinder head sealing plane; and at least one supply bore originating from the cylinder head sealing plane and which opens into the cooling distribution duct.

8. The cylinder head of claim 1, wherein the at least one second cooling bore is arranged in a region of the fire deck.

9. The cylinder head of claim 1, wherein the at least one second cooling bore is arranged in a region of an interface between the cooling distribution duct and the annular chamber.

10. The cylinder head of claim 1, wherein the cooling distribution duct is drilled into the cylinder head.

11. The cylinder head of claim 1, wherein the cooling distribution duct is pre-cast with the cylinder head.

12. A cylinder head, comprising:

an intake port which opens into a combustion chamber;

an exhaust port per cylinder;

a fuel injection device which opens into the combustion chamber;

a valve web region formed between the intake port and the exhaust port;

an annular chamber concentrically surrounding the fuel injection device and defined by a casting slug and a receiving sleeve, the casting slug having a bore which receives the receiving sleeve and the fuel injection device;

a fire deck;

at least one cooling chamber having a cooling distribution duct which opens into the annular chamber;

at least one first cooling bore extending from the annular chamber to cool the valve web region, and which adjoins the fire deck; and at least one second cooling bore extending from the annular chamber, and which is directed approximately tangentially to an outside surface of the exhaust port facing the at least one cooling chamber.

13. The cylinder head of claim 12, wherein the at least one third cooling bore is spaced from the at least one second cooling bore relative to a direction of the cylinder axis.

14. The cylinder head of claim 12, wherein the cooling distribution duct has a flow cross-section which is greater than a flow cross-section of the at least one first cooling bore.

15. The cylinder head of claim 12, wherein the cooling distribution duct has a flow cross-section which is at least twice as great as a flow cross-section of the at least one first cooling bore.

16. The cylinder head of claim 12, wherein the axis of the at least one first cooling bore and the axis of the cooling distribution duct are aligned in parallel.

17. The cylinder head of claim 12, wherein the axis of the at least one first cooling bore and the axis of the cooling distribution duct are coaxial.

18. The cylinder head of claim 12, further comprising:

a cylinder head sealing plane; and at least one supply bore originating from the cylinder head sealing plane and which opens into the cooling distribution duct.

19. The cylinder head of claim 12, wherein the at least one second cooling bore is arranged in a region of an interface between the cooling distribution duct and the annular chamber.

20. A cylinder head, comprising:

an intake port which opens into a combustion chamber;

an exhaust port per cylinder;

a fuel injection device which opens into the combustion chamber;

an annular chamber concentrically surrounding the fuel injection device and defined by a casting slug and a receiving sleeve, the casting slug having a bore which receives the receiving sleeve and the fuel injection device;

at least one cooling chamber having a cooling distribution duct through which a coolant flows, and which opens into the annular chamber;

a plurality of cooling bores extending from the annular chamber, at least one of said cooling bores being directed approximately tangentially to an outside surface of the exhaust port facing the at least one cooling chamber, wherein the cooling distribution duct has a flow cross-section which is greater than a flow cross-section of the plurality of cooling bores.

* * * * *